United States Patent [19]

Masuda et al.

[11] Patent Number: 4,714,059

[45] Date of Patent: Dec. 22, 1987

[54] SINGLE OVERHEAD CAMSHAFT ENGINE

[75] Inventors: Shuji Masuda; Hiroyuki Oda, both of Hiroshima, Japan

[73] Assignee: Mazda Motor Corporation, Hiroshima, Japan

[21] Appl. No.: 857,064

[22] Filed: Apr. 29, 1986

[30] Foreign Application Priority Data

Apr. 30, 1985 [JP] Japan ..... 60-94504

[51] Int. Cl.[4] ..... F01L 1/26

[52] U.S. Cl. ..... 123/90.23; 123/90.4; 123/315

[58] Field of Search ..... 123/90.39, 90.27, 90.22, 123/90.23, 90.4, 90.44, 315, 432, 90.41

[56] References Cited

U.S. PATENT DOCUMENTS

| | | | |
|---|---|---|---|
| 3,699,933 | 10/1972 | Treiber | 123/90.27 |
| 3,734,071 | 5/1973 | Mettig et al. | 123/90.27 |
| 4,267,811 | 5/1981 | Springer | 123/90.27 |
| 4,549,510 | 10/1985 | Miyakoshi et al. | 123/90.44 |
| 4,553,515 | 11/1985 | King et al. | 123/90.27 |
| 4,561,391 | 12/1985 | Simko | 123/90.4 |
| 4,576,128 | 3/1986 | Kenichi | 123/90.27 |

FOREIGN PATENT DOCUMENTS

| | | | |
|---|---|---|---|
| 843329 | 7/1952 | Fed. Rep. of Germany | 123/90.45 |
| 2646852 | 4/1978 | Fed. Rep. of Germany | 123/90.27 |
| 0102506 | 6/1982 | Japan | 123/90.27 |
| 151104 | 11/1982 | Japan . | |
| 0187706 | 9/1985 | Japan | 123/90.17 |
| 2159877 | 12/1985 | United Kingdom | 123/90.23 |

*Primary Examiner*—Craig R. Feinberg
*Assistant Examiner*—David A. Okonsky
*Attorney, Agent, or Firm*—Burns, Doane, Swecker & Mathis

[57] ABSTRACT

An internal combustion engine with single overhead camshaft which comprises a cylinder block having at least one cylinder bore and accommodating therein a piston, and a cylinder head having a bottom wall flattened at a surface area confronting a combustion chamber, and firmly mounted on the cylinder block. The bottom wall has a pair of intake ports and a pair of exhaust ports which are selectively closed and opened by separate intake valves, one for each intake port, and separate exhaust valves, one for each exhaust port. The intake and exhaust valves are supported by the cylinder head for movement in a direction generally perpendicular to the planar surface of the bottom wall. A single overhead camshaft extends above and between the intake valves and the exhaust valves transversely of the longitudinal axis of the cylinder bore, and has first and second cam means. The piston has a flat top end face confronting, and generally in parallel relationship with, the planar surface of the bottom wall of the cylinder head and has a cavity defined in said flat top end face. The cylinder head also has a socket defined therein so as to extend completely through the thickness of the bottom wall for the support of either an ignition plug or a fuel injector nozzle.

26 Claims, 4 Drawing Figures

SINGLE OVERHEAD CAMSHAFT ENGINE

BACKGROUND OF THE INVENTION

The present invention generally relates to an internal combustion engine with single overhead camshaft and, more particularly, to the internal combustion engine of a type wherein intake and exhaust valves are driven by a single overhead camshaft generally in opposite sense with respect to each other through rocker arms.

The single overhead camshaft engine, or SOHC engine for short, is not a recent development and has long been well known in the art, generally in the following two models:

As exemplified by the engine disclosed in, for example, the Japanese Laid-open Patent Publication No. 55-151104, published Nov. 25, 1980, the first model makes use of paired intake valves and paired exhaust valves both supported in the cylinder head for movement in a direction generally parallel to the longitudinal axis of the engine cylinder, and also of a single rocker arm support shaft supported by the cylinder head so as to extend between the paired intake valves and the paired exhaust valves in a direction perpendicular to the longitudinal axis of the engine cylinder. The rocker arm support shaft carries first paired rocker arms for driving the respective intake valves and second paired rocker arms for driving the respective exhaust valves, said first and second paired rocker arms extending laterally outwardly from the rocker arm support shaft in opposite directions away from each other. The single overhead camshaft, having cams for driving the intake and exhaust valves through the associated rocker arms, extends immediately above the rocker arm support shaft parallel thereto.

The paired intake ports and the paired exhaust ports, which are selectively opened and closed by the paired intake valves and the paired exhaust valves, are defined in a bottom wall of the cylinder head so as to confront the cylinder bore, defined in the cylinder block and accommodating the reciprocateable piston. The area of the cylinder head bottom wall, where all the intake and exhaust ports are opened and which confronts the cylinder bore, is inwardly recessed or concaved a slight distance, for example, 3 to 4 mm at maximum, so as to define the top of the combustion chambers, and, on the other hand, the piston has its top end face axially inwardly concaved.

The engine disclosed in Publication No. 55-151104 is described as employed in the form of either a gasoline powered engine or a diesel engine and, for this purpose, the use is disclosed of either the ignition plug or the fuel injector nozzle. Regardless of the type of fuel used, a socket for the support of either the ignition plug or the fuel injector nozzle is defined in the cylinder head bottom wall so as to extend at an angle relative to the longitudinal axis of the engine cylinder and has one of its opposite ends opening into the combustion chamber at a location lying on the longitudinal axis of the engine cylinder, a substantially intermediate portion of said socket extending diagonally upwardly between the intake valves.

The other model is exemplified by the engine disclosed in, for example, the Japanese Laid-open Patent Publication No. 57-102506, published June 25, 1982. Except that that area of the cylinder head bottom wall which confronts the cylinder bore is inwardly concaved in a depth greater than that disclosed in the first mentioned publication, and that the paired intake valves and the paired exhaust valves used in the last mentioned publication are inclined so as to move in respective directions diverging away from each other in a direction upwardly of the cylinder head, the engine disclosed in the last mentioned publication is similar to that disclosed in the first mentioned publication. The camshaft is, however, positioned between the paired intake valves and the paired exhaust valves and closer to the cylinder head bottom wall, while the paired rocker arms for the paired intake valves and those for the exhaust valves are positioned above the camshaft.

It has been found, however, that both models have their own problems. More specifically, in the case of the first mentioned model, since that surface area of the cylinder head bottom wall, which confronts the cylinder bore and constitutes a top wall for the combustion chamber, is inwardly concaved or recessed in such a manner that the distance as measured between the plane of a surface of the cylinder block, at which the cylinder bore is opened, and the top wall of the combustion chamber in a direction parallel to the longitudinal axis of the cylinder bore, increases progressibely from the perimeter of the cylinder bore towards the longitudinal axis of the cylinder bore, a squash area, that is, an area of the combustion chamber which is delimited between the top end face of the piston and the top wall of the combustion chamber when the piston has been moved to a top dead center position, is so small that the combustible air-fuel mixture within the combustion chamber can hardly be vigorously squashed by the piston arriving at the top dead center position.

Moreover, since the socket for the support of either the ignition plug or the fuel injector nozzle extends diagonally downwards between the intake ports, the space available for the formation of the intake ports in the cylinder head bottom wall is correspondingly limited, with no freedom of design of the increased intake ports consequently available.

In the case of the last mentioned model, in addition to the above discussed problem attributable to the inwardly concaved surface area defining the top wall of the combustion chamber, there is another problem in that for each of the rocker arms for the exhaust valves, a stud shaft is employed for supporting the respective rocker arm. The use of the separate stud shafts for supporting the rocker arms for the exhaust valves is necessitated to provide the space between the stud shafts, through which the ignition plug can be inserted into the plug support socket. This means that, when the engine has a plurality of engine cylinders, the stud shafts, for the support of the respective rocker arms for the paired exhaust ports, are necessitated in a number double the number of the engine cylinders.

SUMMARY OF THE INVENTION

Accordingly, the present invention has been developed with a view to substantially eliminating the above discussed problems inherent in the prior art SOHC engines, and has for its essential object to provide an improved SOHC engine, wherein the squash area responsible for increasing the combustion speed can be formed within the combustion chamber without requiring any reduction in the amount of gaseous medium to be introduced into the combustion chamber.

Another important object of the present invention is to provide an improved SOHC engine of the type referred to above, wherein a valve drive mechanism, of a unique construction effective to make it possible to obtain the large squash area within the combustion chamber, is employed.

In order to accomplish these objects of the present invention, there is provided an internal combustion engine with single overhead camshaft, which comprises a cylinder block having at least one cylinder bore defined therein and accommodating therein a piston, and a cylinder head, which has a bottom wall and which is firmly mounted on the cylinder block with the bottom wall defining a combustion chamber in cooperation with the piston and a wall of the cylinder block surrounding the cylinder bore. At least a surface area of the bottom wall which confronts the combustion chamber is a planar surface, while a pair of intake ports and a pair of exhaust ports are defined in the bottom wall and open at the planar surface so as to confront the combustion chamber.

Separate intake valve means are employed, one for each of the intake ports, for selectively opening and closing the respective intake ports. Separate exhaust valve means are also employed, one for each of the exhaust ports. All the intake and exhaust valve means are supported by the cylinder head for movement in a direction generally perpendicular to the planar surface of the bottom wall.

A single overhead camshaft, rotatably supported by the cylinder head, above and between the intake valve means and the exhaust valve means so as to extend transversely to the longitudinal axis of the cylinder bore, and has first and second cam means operatively associated with the intake and exhaust valve means respectively. First and second rocker arm means are angularly displaceably mounted on a support shaft means, and operatively associated with the intake and exhaust valve means respectively.

The piston has a flat top end face confronting, and generally in parallel relationship to, the planar surface of the bottom wall of the cylinder head, and has a cavity defined in said flat top and face.

The cylinder head also has a socket defined therein, so as to extend completely through the thickness of the bottom wall, for the support of either an ignition plug or a fuel injector nozzle. The opening of the socket defined in the planar surface, so as to confront the combustion chamber, may be located, either, between the paired exhaust ports, or at a central location within the region bound by the paired intake and exhaust ports.

BRIEF DESCRIPTION OF THE DRAWINGS

This and other objects and features of the present invention will become clear from the following description, taken in conjunction with preferred embodiments thereof, with reference to the accompanying drawings, in which.

DETAILED DESCRIPTION OF THE EMBODIMENTS

Figure 1:
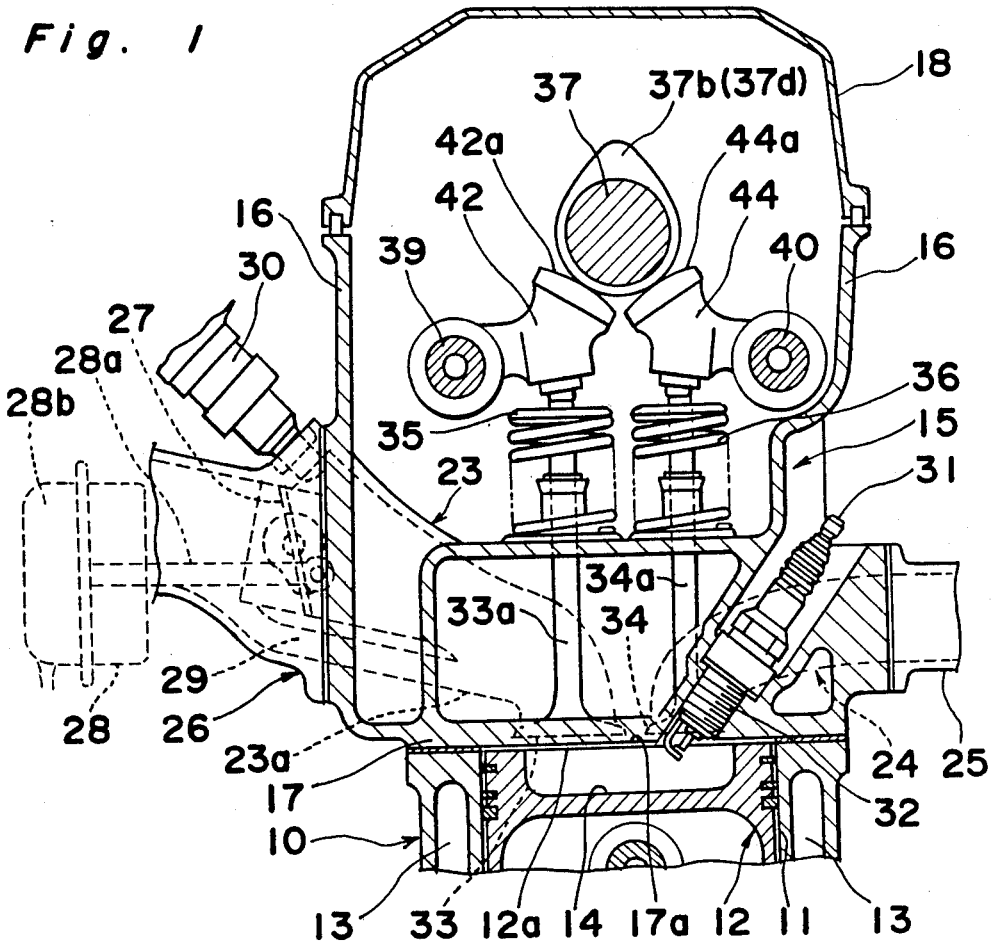
FIG. 1 is a fragmentary transverse sectional view of a multicylinder in-line SOHC (single overhead camshaft) engine according to a first preferred embodiment of the present invention.

Before the description of the present invention proceeds, it is to be noted that like parts are designated by like reference numerals throughout the accompanying drawings. It is also to be noted that, while the present invention is applicable not only to the gasoline powered internal combustion engine, but also to the diesel engine, reference will be made to the gasoline engine in describing the preferred embodiments of the present invention.

Figure 2:
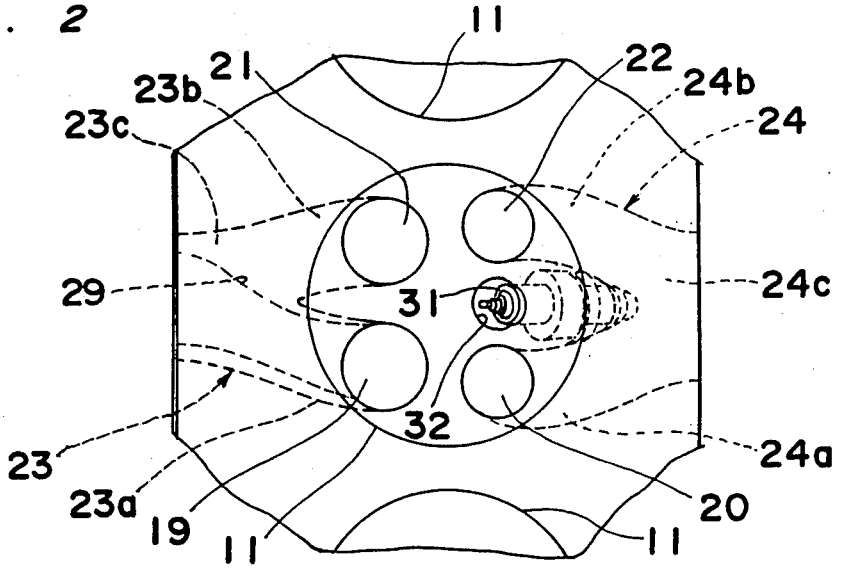
FIG. 2 is a schematic plan view of a cylinder head employed in the engine shown in FIG. 1.
Figure 3:
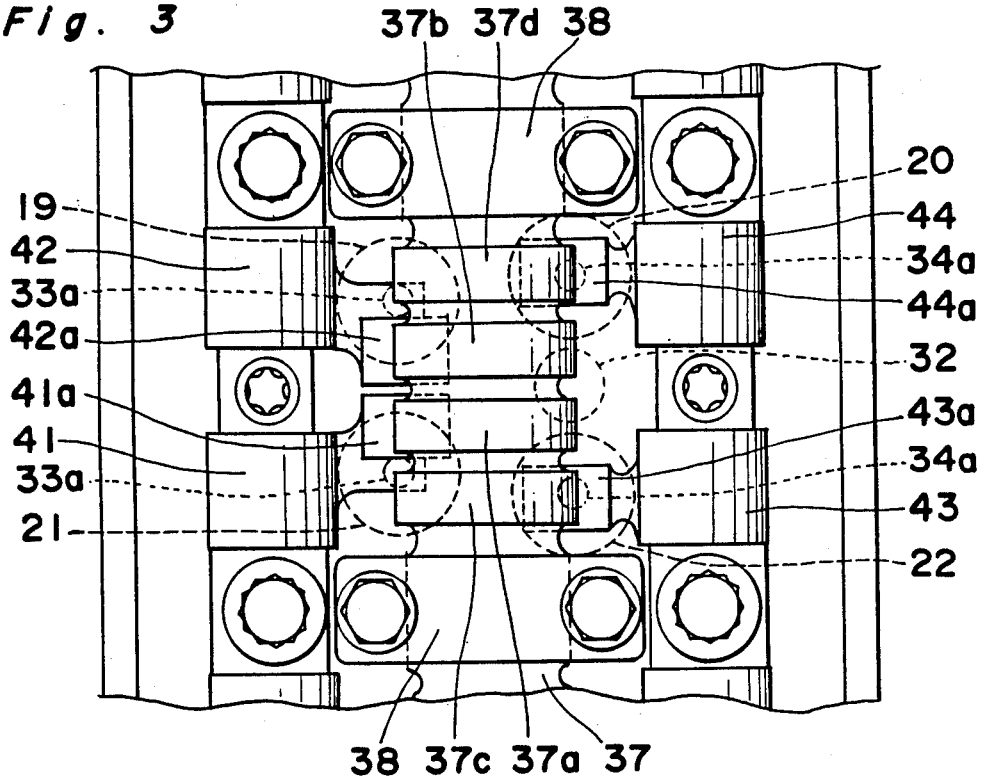
FIG. 3 is a top plan view, on an enlarged scale, of the engine shown in FIG. 1, with a cylinder head cover removed.

Referring first to FIGS. 1 to 3, a multicylinder in-line SOHC engine, shown therein, comprises a cylinder block 10, having a row of in-line cylinder bores 11 defined therein, and accommodating pistons 12 for movement within such respective cylinder bores 11. As is well known to those skilled in the art, the pistons 12 are operatively coupled with a crankshaft through respective connecting rods. The cylinder block 10 also has a continuous coolant jacket 13, defined in the wall forming the cylinder block, for the flow of the engine cooling water. Each of the pistons 12 is of a cylindrical configuration and has a flat top end face **12*a* recessed axially inwardly to provide a piston cavity 14, rendering the flat top end face 12*a*** to be annular in shape.

The engine also comprises a cylinder head 15 of a generally rectangular, open-topped, box-like configuration having a pair of opposite side walls 16, a pair of opposite end walls (not shown) and a bottom wall 17, said bottom wall 17 having a planar exterior surface **17*a*. As a matter of design, the cylinder head 15 is mounted on the cylinder block 10 and firmly bolted thereto, with respective tops of the cylinder bores 11 closed by the planar exterior surface 17*a* of the cylinder head 15. Thus, the engine has variable-volume combustion chambers, one for each cylinder bore 11. Each of said combustion chambers is delimited by the wall surrounding the respective cylinder bore 11, the respective piston 12 and a respective portion of the planar exterior surface 17 of the cylinder head 15 which is in register with such respective cylinder bore 11**.

Mounted atop the cylinder head 15 is a cylinder head cover 18, the function of which is well known to those skilled in the art.

For each engine cylinder or combustion chamber, the cylinder head 15 has two intake ports 19 and 21 and two exhaust ports 20 and 22 both defined in the bottom wall 17 thereof in communication with the respective combustion chamber. More specifically, for each engine cylinder, the cylinder head 15 is cast together with a generally Y-shaped intake duct 23, including two branch passages **23*a* and 23*b*, communicated at one end with the respective intake ports 19 and 21, and a trunk passage 23*c*, having one end opening at one of the side walls 16 and the other end communicated with both of the branch passages 23*a* and 23*b*. The junction of these passages 23*a* to 23*c* is situated with the cylinder head 15. Similarly, for each engine cylinder, the cylinder head 15 is also cast together with a generally Y-shaped exhaust duct 24, including two branch passages 24*a* and 24*b*, communicated at one end with the respective exhaust ports 20 and 21, and a trunk passage 24*c* having one end opening at the other of the side walls 16, and the other end communicated with both of the branch passages 24*a* and 24*b*. The junction of these passages 24*a* to 24*c* is situated within the cylinder head 15**.

While the exhaust ducts 24, for all the engine cylinders, connect the exhaust ports 20 and 21 to the atmosphere, either directly or through any known exhaust purifying unit, by way of an exhaust manifold (only a portion thereof being shown by 25 in FIG. 1) for the discharge of exhaust gases out from the associated combustion chambers, the intake ducts 23 for all of the engine cylinders connect the intake ports 19 and 21 to a source of fresh air through an intake manifold for the introduction of fresh air into the associated combustion chambers in a controlled manner, a portion of said intake manifold being shown by 26 in FIGS. 1 and 2. The intake manifold 26 is to be understood as having a plurality of intake tubes 26*a* generally equal in number to the engine cylinders and aggregated together so that the intake air can be, after being controlled by a throttle valve (not shown), distributed to all of the combustion chambers. The throttle valve for regulating the amount of the intake air disposed inbetween an air cleaner and the intake manifold 26, as is well known to those skilled in the art.

So far shown, each intake tube 26*a*, of the intake manifold 26, has a control valve 27 disposed therein for selectively closing and opening the respective intake tube 26*a*. This control throttle valve 27 can be controlled by a diaphragm valve assembly, shown in FIG. 1, by the phantom line 28, and operatively coupled therewith by means of a connecting rod 28*a*, and has a working chamber 28*b*, defined therein, and fluid-connected with a portion of the intake passage system between the control valve and throttle valve. Thus, it will readily be seen that the control valve 27 is in a closed position during a low load engine operating condition during which the negative pressure developed in the intake passage system downstream of the throttle valve is high, but is moved towards an opened position when the load on the engine attains a value equal to, or higher than, a predetermined value, accompanied by the reduction in negative pressure.

As best shown in FIGS. 1 and 2, a system, including each intake tube 26*a*, the associated trunk passage 23*c*, and one of the branch passages, for example, the branch passage 23*a*, has a bypass passage 29 extending from a portion of the respective intake tube 26*a*, upstream of the associated control valve 27, to a portion of the respective branch passage 23*a*, downstream of the junction of all of the associated passages 23*a*, 23*b* and 23*c* while bypassing the associated control valve 27 so that, when the control valve 27 is in the closed position, the intake air can be supplied into the associated combustion chamber only through the respective bypass passage 29.

Also, so far shown, for each engine cylinder, a fuel injection nozzle 10 is employed and supported in any suitable manner, for example, at a flanged end of the respective intake tube 26*a* of the intake manifold 26, adjacent the side wall 16, so that a controlled quantity of fuel can be injected into the intake system downstream of the respective control valve 27 and into the associated combustion chamber through the associated intake ports 19 and 21.

Referring to only one of the engine cylinders for the sake of brevity, the system so far described operates in the following manner. During the low load engine operating condition with the control valve 27 consequently held in the closed position, the intake air is introduced, or drawn, into the combustion chamber only through the bypass passage 29, and then through the intake port 19, subsequently mixes with fuel, and is injected from the fuel injection nozzle 30, while causing the resultant combustible air-fuel mixture to swirl vigorously within the combustion chamber. On the other hand, when the control valve 27 is pivoted towards the opened position as a result of the load on the engine exceeding the predetermined value, the incoming fresh air flows past the control valve 27 and is mainly supplied through the intake passages 23*a* and 23*b* into the combustion chamber by way of the intake ports 19 and 21. The swirling motion of the resultant combustible mixture takes place similarly within the combustion chamber.

Referring still to FIGS. 1 to 3, the engine employs an ignition plug 31 for each engine cylinder, which plug 31 is firmly received in a socket 32, defined in the bottom wall 17 of the cylinder head 15 so as to extend completely through the thickness of the bottom wall 17. This socket 32 is so positioned as to open towards the combustion chamber at a location substantially intermediate between the exhaust ports 21 and 22 as best shown in FIG. 2, it being be noted that the paired intake ports 19 and 21, for each engine cylinder, and the paired exhaust ports 20 and 22, for each engine cylinder, are arranged on respective sides of a vertical center plane, parallel to the longitudinal sense of the engine as a whole and including the longitudinal axes of all of the engine cylinders, i.e., those of the cylinder bores 11. The ignition plug 31 has spark electrodes at tip thereof and is supported in the socket 12 with the spark electrodes thereof confronting, and preferably projecting a predetermined distance from the planar exterior surface 17*a* of the bottom wall 17, into the associated combustion chamber.

The paired intake ports 19 and 21 for each engine cylinder are adapted to be selectively opened and closed by respective intake valves, generally identified by 33, each having a valve stem 33*a*. On the other hand, the paired exhaust ports 20 and 22 for each engine cylinder are adapted to be selectively opened and closed in any known timing, but in opposite relationship with the intake ports 19 and 21 by respective exhaust valves, generally identified by 34, each having a valve stem 34*a*. All of these valves 33 and 34 are so supported as to permit the respective valve stems 33*a* and 34*a* to extend parallel to each other and also parallel, or substantially parallel, to the longitudinal axis of the associated engine cylinder, and are normally biased upwards by springs 35 and 36 so as to close the intake and exhaust ports 19, 21 and 20, 22.

Arranged within the interior of the cylinder head 15, generally confined by the cylinder head cover 18 and positioned above free ends of the valve stems 33*a* and 34*a* of the intake and exhaust valves 33 and 34, is a valve drive mechanism which will now be described with particular reference to FIGS. 1 and 3.

The valve drive mechanism for the SOHC engine, to which the present invention exclusively pertains, comprises a single camshaft 37 rotatably supported by bearings 38 integral or fast with the cylinder head 15 so as to extend above the row of the engine cylinders in a direction lengthwise of the engine as a whole, with its longitudinal axis lying generally in the same vertical center plane as that including the longitudinal axes of all of the engine cylinders. For each engine cylinder, the camshaft 37 has, integrally formed therewith, a pair of cams 37*a* and 37*b* for driving the intake valves 33 respectively in a manner as will become clear from the subsequent description and, also, a pair of cams 37*c* and 37*d* for driving the exhaust valves 34 respectively in a manner as will become clear from the subsequent description, said cams 37*c* and 37*d* being positioned on respective sides of the pair of cams 37*a* and 37*b* with respect to the lengthwise direction of the camshaft 37.

The valve drive mechanism also comprises a pair of spaced rocker arm support shafts 39 and 40, rigidly on cylinder head 15 and extending parallel to the camshaft 37 at a level below the camshaft 37, but above the free ends of the valve stems 33*a* and 34*a* so that the respective longitudinal axes of the shafts 37, 39 and 40 can occupy respective apexes of the shape of an isosceles triangle having its base parallel to the planar exterior surface 17*a* of the cylinder head bottom wall 17, while the free ends of all of the valve stems 33*a* and 34*a* are positioned between the support shafts 39 and 40. Thus, the rocker arm support shafts 39 and 40 are spaced an equal distance from the camshaft 37 and also from the vertical center plane parallel to the longitudinal sense of the engine and including the longitudinal axes of the engine cylinders. Two rocker arms 41 and 42 for each paired intake valves 33 are mounted on the support shaft 39 in spaced relation to each other for rotation about, and independently, of the support shaft 39, and similarly, two rocker arms 43 and 44 for each paired exhaust valves 34 are mounted on the support shaft 40 in spaced relation to each other for rotation about, and independently, of the support shaft 40.

The rocker arms 41 and 42, so mounted on the support shaft 39, protrude laterally outwards from the shaft 39 towards the vertical center plane referred to above and terminate in engagement with the respective free ends of the valve stems 33*a* of the intake valves 33. These rocker arms 41 and 42 have respective cam abutments 41*a* and 42*a* defined therein so as to confront, and be slidingly engaged with, the associated cams 37*a* and 37*b* on the camshaft 37.

Similarly, the rocker arms 43 and 44, mounted on the support shaft 40, protrude laterally outwards from the shaft 40 towards the vertical center plane referred to above, or in a direction close towards the rocker arms 41 and 42 on the shaft 39, and terminate in engagement with the respective free ends of the valve stems 34*a* of the exhaust valves 34. These rocker arms 43 and 44 also have respective cam abutments 43*a* and 44*a* defined therein so as to confront, and be slidingly engaged with, the associated cams 37*c* and 37*d* on the camshaft 37.

As best shown in FIGS. 1 and 3, in order to maximize the utilization of space available within the cylinder head 15, all of the cams 37*a* to 37*d* on the camshaft 37 for each engine cylinder are located within a column of space coaxially bound by the cylinder bore 11. The cams 37*a* and 37*b* associated with the intake ports 19 and 21, respectively, are positioned between the cams 37*c* and 37*d* associated respectively with the exhaust ports 20 and 22 while the rocker arms 43 and 44 are permitted to align with the respective cams 37*c* and 37*d*. In view of this, the cam abutments 41*a* and 42*a* are defined in the rocker arms 41 and 42 at respective positions offset inwardly from the longitudinal extensions of the valve stems 33*a* in a direction close towards each other whereby they are aligned with the associated cams 37*a* and 37*b*. More specifically, while each of the rocker arms 43 and 44 is of a construction wherein both of the cam abutments 43*a* or 44*b* and a region of the rocker arm 43 or 44, held in engagement with the free end of the associated valve steam 34*a*, align with the longitudinal extension of the associated valve stem 34*a*, each of the rocker arms 41 and 42 is of a construction wherein the cam abutment 41*a* or 42*a* and a region of the rocker arm 41 or 42, held in engagement with the free end of the associated valve stem 33*a*, are displaced or offset from each other in a direction parallel to the support shaft 39 with respect to the longitudinal extension of the associated valve stem 33*a*, while that region of the rocker arm 41 or 42 remains aligned with the longitudinal extension of the associated valve stem 33*a*.

Referring to only one of the engine cylinders for the sake of brevity, the combustible air-fuel mixture supplied into the combustion chamber in any known manner during the suction stroke of the engine is compressed as the piston 12 undergoes the compression stroke. At this time, a portion of the combustible mixture standing in a squash area, that is, a portion of the combustion chamber delimited between the planar exterior surface 17*a* of the cylinder head bottom wall 17 and the annular flat top end face 12*a* of the piston 12, is, as the piston 12 approaches the top dead center position, vigorously squashed to flow radially inwardly into the remaining portion of the combustion chamber, producing a squash flow of combustible mixture with which the combustible mixture can be uniformly mixed.

On the other hand, the opening of the socket 32, for the support of the ignition plug 31 which confronts the combustion chamber, is positioned generally intermediate between the paired exhaust ports 20 and 22, as best shown in FIG. 2, and at such a position as to permit the spark electrodes of the ignition plug 32 to confront a portion of the combustion chamber where the combustible mixture being vigorously swirled exhibits a relatively high density of fuel and is therefore easy to ignite. Accordingly, the presence of the socket 32 at a unique location, such as described hereinabove, will not impose an undesirable limitation on the design of the paired intake ports 19 and 21, making it possible to employ the intake ports of a surface area as large as possible.

The uniform mixing of the combustible mixture, resulting from the squash flow of combustible mixture within the combustion chamber and the increase of the air drawn into the combustion chamber resulting from the employment of the intake ports of increased surface area, makes it possible for the engine as a whole to produce an increased power output.

Furthermore, since all the valve stems 33*a* and 34*a* of the intake and exhaust valves 33 and 34 are supported so as to extend parallel to each other and to the longitudinal axis of the cylinder head and at right angles to the planar exterior surface 17*a* of the cylinder head bottom wall 17, the rocker arm support shaft 39, associated with the intake valves 33, and the rocker arm support shaft 40, associated with the exhaust valves 34, can be advantageously positioned close to each other with the rocker arms 42 and 44 effectively positioned therebetween, making it possible to reduce the width of the engine.

Figure 4:
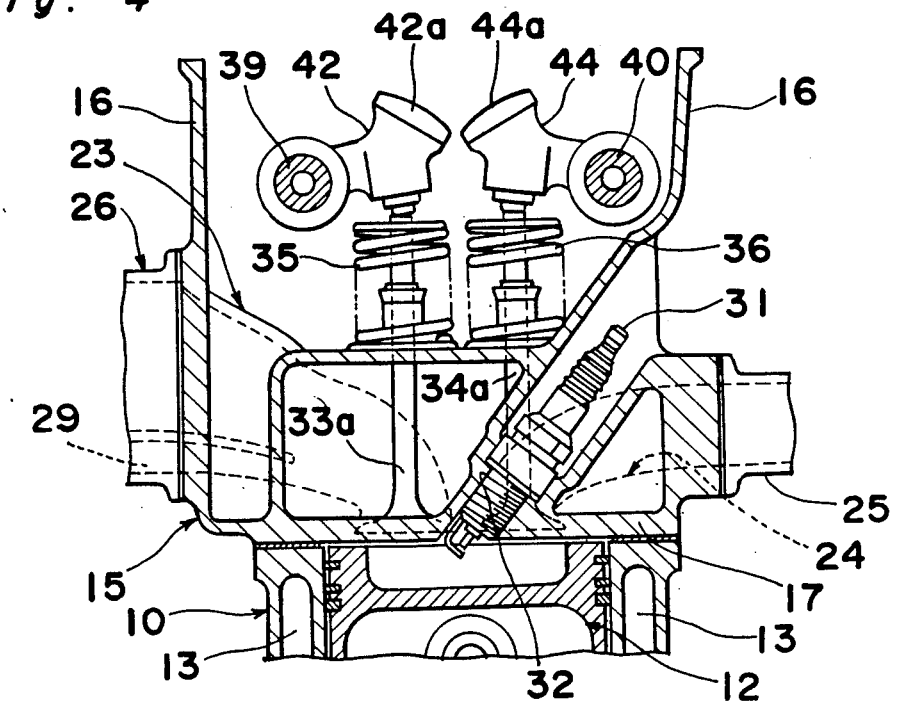
FIG. 4 is a view similar to FIG. 1, showing the engine according to another preferred embodiment of the present invention.

Although the present invention has been fully described, it is to be noted that various changes and modifications are apparent to those skilled in the art upon the reading of the description thereof. By way of example, if desired, the socket 32 for the support of the ignition plug 31 may be defined in the cylinder head 15 so that the opening thereof, confronting the combustion chamber, can be aligned substantially with the longitudinal axis of the engine cylinder or be located at a position generally spaced an equal distance from any one of the intake and exhaust ports, as shown in FIG. 4.

Moreover, the socket 32 may not be used to support the ignition plug 31, but may be used to support a fuel injector nozzle having its discharge port confronting the combustion chamber. In other words, the concept of the present invention can be applicable to the diesel engine, in which case the fuel injector nozzle 30 for injecting fuel into the intake system is not utilized, and the fuel injector nozzle designed to inject oil should supersede the ignition plug.

We claim:

1. An internal combustion engine with single overhead camshaft which comprises:

a cylinder block having at least one cylinder bore defined therein and accommodating therein a piston for reciprocate movement in a direction parallel to the longitudinal axis of the cylinder bore;

a cylinder head mounted firmly on the cylinder block and having a bottom wall, said bottom wall defining a combustion chamber in cooperation with the piston and a wall of the cylinder block surrounding the cylinder bore, said combustion chamber having a volume variable in dependence on the movement of the piston within the cylinder bore, at least a surface area of the bottom wall which confronts the combustion chamber being a planar surface; said piston, having a flat top end face, confronting, and generally in parallel relationship with, the planar surface of the bottom wall of the cylinder head, and having a cavity defined in said flat top end face;

said bottom wall having a pair of intake ports defined therein for the introduction of intake gas into the combustion chamber, and also having a pair of exhaust ports defined therein for the discharge of exhaust gases from the combustion chamber;

separate intake valve means, one for each of the intake ports, for selectively opening and closing the respective intake ports, and separate exhaust valve means, one for each of the exhaust ports, for selectively opening and closing the respective exhaust ports generally in opposite sense to the selective opening and closing of the intake ports, all of said intake and exhaust valve means are supported by the cylinder head for movement in a direction generally perpendicular to the planar surface of the bottom wall;

a camshaft rotatably supported by the cylinder head above and between the intake valve means and the exhaust valve means so as to extend transversely of the longitudinal axis of the cylinder bore and having first and second cam means operatively associated respectively with the intake and exhaust valve means;

a support shaft means supported by the cylinder head;

first and second rocker arm means, swingably mounted on the support shaft means, and operatively associated respectively with the intake and exhaust valve means, the first rocker arm means being operable to transmit a movement of the first cam means on the camshaft to the intake valve means for driving said intake valve means, said second rocker arm means being operable to transmit a movement of the second cam means to the exhaust valve means for driving said exhaust valve means;

a generally elongated combustion aiding means constituted by an ignition plug or a fuel injector nozzle and supported by the cylinder head so as to incline relative to the planar surface of the bottom wall while extending intermediate between exhaust passage means communicated respectively with the exhaust ports, said combustion aiding means having one end exposed to the combustion chamber;

said support shaft means including a first support shaft for supporting the first rocker arm means and a second support shaft for supporting the second rocker arm means; said first and second support shafts being positioned on respective opposite sides of the camshaft adjacent the intake valve means and the exhaust valve means and arranged in symmetrical relation to each other, said second support shaft extending parallel to the camshaft, at least a portion of said combustion aiding means being positioned substantially directly below said second support shaft in a noninterfering relation with said second support shaft.

2. The engine as claimed in claim 1, wherein said one end of the combustion aiding means confronts the cavity in the cylinder.

3. The engine as claimed in claim 2, wherein the cavity in the piston is an axially inwardly recessed cavity coaxial with the piston, and the flat top end face of the piston is annular in shape surrounding the cavity.

4. The engine as claimed in claim 2, wherein said one end of the combustion aiding means protrudes a slight distance into the combustion chamber from the planar surface of the bottom wall.

5. The engine as claimed in claim 2, wherein said one end of the combustion aiding means is located within a portion which is delimited by the intake and exhaust ports.

6. The engine as claimed in claim 5, wherein said one end of the combustion aiding means is positioned intermediate between the exhaust ports.

7. The engine as claimed in claim 5, wherein said one end of the combustion aiding means is positioned at a location spaced an equal distance from all of the intake and exhaust ports.

8. The engine as claimed in claim 1, wherein the combustion aiding means is securely received in a socket defined in the bottom wall of the cylinder head so as to extend through the bottom wall in a noninterfering relation with the second support shaft.

9. The engine as claimed in claim 1, wherein the exhaust valve means has associated therewith valve springs.

10. An internal combustion engine with a single overhead cam shaft which comprises:

a cylinder block having at least one cylinder bore defined therein and a piston for reciprocate movement in a direction parallel to the longitudinal axis of the cylinder bore;

a cylinder head mounted firmly on the cylinder block and having a bottom wall, said bottom wall defining a combustion chamber in cooperation with the piston and a wall of the cylinder block surrounding the cylinder bore, said combustion chamber having a volume variable in dependence on the movement of the piston within the cylinder bore, at least a surface area of the bottom wall which confronts the combustion chamber being a planar surface;

said piston, having a flat top end face, confronting, and generally in parallel relationship with, the planar surface of the bottom wall of the cylinder head, and having a cavity defined in said flat top end face;

said bottom wall having a pair of intake ports defined therein for the introduction of intake gas into the combustion chamber, and also having a pair of exhaust ports defined therein for the discharge of exhaust gases from the combustion chamber;

separate intake valve means, one for each of the intake ports, for selectively opening and closing the respective intake ports, and separate exhaust valve means, one for each of the exhaust ports, for selectively opening and closing the respective exhaust ports generally in opposite sense to the selective opening and closing of the intake ports, all of said intake and exhaust valve means being supported by the cylinder head for movement in a direction generally perpendicular to the planar surface of the bottom wall;

a cam shaft rotatably supported by the cylinder head above and between the intake valve means and the exhaust valve means so as to extend transversely of the longitudinal axis of the cylinder bore and having first and second cam means operatively associated respectively with the intake and exhaust valve means;

a support shaft means supported by the cylinder head;

first and second rocker arms means, swingably mounted on the support shaft means, and operatively associated respectively with the intake and exhaust valve means, the first rocker arm means being operable to transmit a movement of the first cam means on the cam shaft to the intake valve means for driving said intake valve means, said second rocker arms means being operable to transmit a movement of the second cam means to the exhaust valve means for driving said exhaust valve means;

the support shaft means comprising a first support shaft, for the support of the first rocker arm means, and a second support shaft, for the support of the second rocker arm means, said first and second support shafts being positioned on opposite sides of the cam shaft adjacent the intake valve means and the exhaust valve means;

the first and second support shafts extend parallel to each other and also to the camshaft, and wherein, when viewed in a direction parallel to the axis of the bore, the intake valve means are positioned generally intermediately between the camshaft and the first support shaft, and the exhaust valve means are positioned generally intermediately, between the camshaft and the second support means; and a generally elongated combustion aiding means constituted by an ignition plug or a fuel injector nozzle and supported by the cylinder head so as to incline relative to the planar surface of the bottom wall while extending intermediately between exhaust passage means communicated respectively with the exhaust ports, said combustion aiding means having one end exposed to the combustion chamber and extending generally perpendicular to the longitudinal axis of the second support shaft and between the second support shaft and the opening defined in the cylinder head in communication with each of the exhaust ports for external connection with an exhaust manifold.

11. An internal combustion engine with single overhead cam shaft which comprises:

a cylinder block having at least one cylinder bore defined therein and accommodating therein a piston for reciprocate movement in a direction parallel to the longitudinal axis of the cylinder bore;

a cylinder head mounted firmly on the cylinder block and having a bottom wall, said bottom wall defining a combustion chamber in cooperation with the piston and a wall of the cylinder block surrounding the cylinder bore, said combustion chamber having a volume variable in dependence on the movement of the piston within the cylinder bore, at least a surface area of the bottom wall confronting the combustion chamber being a planar surface;

said piston, having a flat top end face, confronting, and generally in parallel relationship with, the planar surface of the bottom wall of the cylinder head and having a cavity defined in said flat top end face;

said bottom wall having a pair of intake ports defined therein for the introduction of intake gas into the combustion chamber, and also having a pair of exhaust ports defined therein for the discharge of exhaust gases from the combustion chamber;

separate intake valve means, one for each of the intake ports, for selectively opening and closing the respective intake ports, and separate exhaust valve means, one for each of the exhaust ports, for selectively opening and closing the respective exhaust ports generally in opposite sense to the selective opening and closing of the intake ports, all of said intake and exhaust valve means are supported by the cylinder head for movement in a direction generally perpendicular to the planar surface of the bottom wall;

a cam shaft rotatably supported by the cylinder head above and between the intake valve means and the exhaust valve means so as to extend transversely of the longitudinal axis of the cylinder bore and having first and second cam means operatively associated respectively with the intake and exhaust valve means;

a support shaft means supported by the cylinder head;

first and second rocker arm means, swingably mounted on the support shaft means, and operatively associated respectively with the intake and exhaust valve means, the first rocker arm means being operable to transmit a movement of the first cam means on the cam shaft to the intake valve means for driving said intake valve means, said second rocker arms means being operable to transmit a movement of the second cam means to the exhaust valve means for driving said exhaust valve means;

said support shaft means comprising a first support shaft, for the support of the first rocker arm means, and a second support shaft, for the support of the second rocker arm means, said first and second support shafts being positioned on opposite sides of the cam shaft adjacent the intake valve means and the exhaust valve means, the second rocker arm means comprises two rocker arms for each exhaust port and wherein the second cam means comprises two cams for each rocker arm and positioned on the camshaft on respective sides of the first cam means with respect to the direction axially of the camshaft; and a generally elongated combustion aiding means constituted by an ignition plug or a fuel injector nozzle and supported by the cylinder head so as to incline relative to the planar surface of the bottom wall while extending intermediate between exhaust passage means communicated respectively with the exhaust ports, said combustion aiding means having one and exposed to the combustion chamber.

12. An internal combustion engine with single overhead camshaft which comprises:

a cylinder block having at least one cylinder bore defined therein, and accommodating therein a piston for reciprocate movement in a direction of the longitudinal axis of the cylinder bore;

a cylinder head having a bottom wall and firmly mounted on the cylinder block with the bottom wall defining a combustion chamber in cooperation with the piston and a wall of the cylinder block surrounding the cylinder bore, said combustion chamber having a volume variable in dependence on the movement of the piston within the cylinder bore;

said bottom wall having a pair of intake ports defined therein for the introduction of an intake gas into the combustion chamber and also having a pair of exhaust ports defined therein for the discharge of exhaust gases from the combustion chamber;

separate intake valve means, one for each of the intake ports, for selectively opening and closing the respective intake ports, and separate exhaust valve means, one for each of the exhaust ports, for selectively opening and closing the respective exhaust ports generally in opposite sense to the selective opening and closure of the intake means being supported by the cylinder head;

a camshaft having an axis and rotatably supported by the cylinder head above and between the intake valve means and the exhaust valve means so as to extend transversely to the longitudinal axis of the cylinder bore and having first and second cam means operatively associated respectively with the intake and exhaust valve means;

first and second support shafts supported by the cylinder head so as to extend parallel to the camshaft and positioned on respective sides of the camshaft adjacent the intake and exhaust valve means;

first and second rocker arm means angularly displaceably mounted on the first and second support shafts, and operatively associated respectively with the intake and exhaust valve means, the first rocker arm means being operable to transmit a movement of the first cam means on the camshaft to the intake valve means for driving said intake valve means while said second rocker arm means is operable to transmit a movement of the second cam means to the exhaust valve means for driving said exhaust means; and said intake valve means having respective portions engaged with the first rocker arm means and positioned between the first support shaft and the camshaft as viewed in the direction along the camshaft axis, while said exhaust valve means have respective portions engaged with the second rocker arm means and positioned between the second support shaft and the camshaft as viewed in the direction of the axis.

13. The engine as claimed in claim 12, wherein the first and second support shafts are positioned closer to the piston than to the camshaft with respect to the axial direction of the cylinder bore.

14. The engine as claimed in claim 13, wherein the first and second rocker arm means are positioned generally between the camshaft and the first support shaft and between the camshaft and the second support shaft, respectively.

15. The engine as claimed in claim 14, wherein at least one of the first and second rocker arm means comprises two rocker arms and wherein one of the first and second cam means, which is operatively associated with said one of the first and second rocker arm means, comprises two cams which are positioned on the camshaft on respective sides of the other of the first and second cam means with respect to the direction axially ofthe camshaft, ones of the intake and exhaust valve means which are operatively associated with said one of the first and second rocker arm means being spaced a greater distance from each other than the others of the intake and exhaust valve means, and further comprising a generally elongated combustion aiding means constituted by either an ignition plug or a fuel injection nozzle and supported by the cylinder head so as to incline relative to a plane in which any one of the intake and exhaust valve means moves, while extending between said ones of the intake and exhaust valve means, said combustion aiding means having one end exposed to the combustion chamber.

16. The engine as claimed in claim 12, wherein all of the intake and exhaust valve means are supported for movement in a direction substantially parallel to the longitudinal axis of the cylinder bore.

17. The engine as claimed in claim 16, wherein the cavity in the piston is an axially inwardly recessed cavity coaxial with the piston and the flat top end face of the piston is annular in shape surrounding the cavity.

18. The engine as claimed in claim 16, wherein at least a surface area of the bottom wall which confronts the combustion chamber is a planar surface and wherein said piston has a flat top end face confronting, and generally in parallel relationship with, the planar surface of the bottom wall and also has a cavity defined therein so as to extend axially inwardly from the flat top end face.

19. The engine as claimed in claim 18, wherein each of the planar surface of the bottom wall and the flat top end face of the piston lies generally perpendicular to the longitudinal axis of the cylinder bore and also to the direction of movement of each of the intake and exhaust valve means.

20. The engine as claimed in claim 12, wherein at least one of the first and second rocker arm means comprises two rocker arms and wherein one of the first and second cam means which is operatively associated with said one of the first and second rocker arm means comprises two cams which are positioned on the camshaft on respective sides of the other of the first and second cam means with respect to the direction axially of the camshaft, ones of the intake and exhaust valve means which are operatively associated with said one of the first and second rocker arm means being spaced a greater distance from each other than the others of the intake and exhaust valve means, and further comprising a generally elongated combustion aiding means constituted by an ignition plug or a fuel injection nozzle and supported by the cylinder head so as to incline relative to a plane in which any one of the intake and exhaust valve means moves, while extending between said ones of the intake and exhaust valve means, said combustion aiding means having one end exposed to the combustion chamber.

21. The engine as claimed in claim 20, further comprising separate passages defined in the cylinder head in communication with said ones of the intake and exhaust ports, respectively, said passages being connected together within the cylinder head, and wherein the combustion aiding means extends intermediate between the passages.

22. The engine as claimed in claim 20, wherein at least a surface area of the bottom wall which confronts the combustion chamber is a planar surface and wherein said piston has a flat top end face confronting, and generally in parallel relationship with, the planar surface of the bottom wall and also has a cavity defined therein so as to extend axially inwardly from the flat top end face, and wherein said one end of the combustion aiding means confronts the cavity in the piston.

23. The engine as claimed in claim 22, wherein said one end of the combustion aiding means protrudes a slight distance into the combustion chamber from the planar surface of the bottom wall.

24. The engine as claimed in claim 22, wherein said one end of the combustion aiding means is located within a portion which is delimited by the intake and exhaust ports.

25. The engine as claimed in claim 24, wherein said one end of the combustion aiding means is positioned intermediate between the exhaust ports.

26. The engine as claimed in claim 24, wherein said one end of the combustion aiding means is positioned at a location in alignment with the longitudinal axis of the cylinder bore.

* * * * *